United States Patent [19]

Tuuha

[11] 4,430,210

[45] Feb. 7, 1984

[54] SCREEN

[75] Inventor: Rolf Tuuha, Pori, Finland

[73] Assignee: Rauma-Repola Oy, Finland

[21] Appl. No.: 243,073

[22] Filed: Mar. 12, 1981

Related U.S. Application Data

[63] Continuation-in-part of Ser. No. 165,863, Jul. 7, 1980, abandoned.

[30] Foreign Application Priority Data

| | | | |
|---|---|---|---|
| Jul. 13, 1979 | [FI] | Finland | 792212 |
| Apr. 2, 1980 | [FI] | Finland | 801045 |
| Apr. 2, 1980 | [FI] | Finland | 801046 |
| Feb. 19, 1981 | [FI] | Finland | 810514 |

[51] Int. Cl.[3] ..... B07B 1/15

[52] U.S. Cl. ..... 209/23.4; 209/254; 209/315; 209/324; 209/339; 209/672; 209/669; 209/409; 209/415

[58] Field of Search ..... 209/2, 233, 234, 236, 209/254, 281, 275-276, 315, 316, 324, 335, 339, 409, 415, 913, 667-669, 671-673

[56] References Cited

U.S. PATENT DOCUMENTS

| | | | |
|---|---|---|---|
| 43026 | 6/1894 | Higley | 209/315 X |
| 182,328 | 9/1876 | Poole | 209/913 |
| 292,656 | 1/1884 | Kidder | 209/669 |
| 1,319,665 | 10/1919 | Hudson | 209/234 X |
| 1,866,171 | 7/1932 | Pavone | 209/315 |
| 1,979,791 | 11/1934 | Blackburn | 209/315 |
| 2,191,504 | 2/1940 | Smith | 209/315 |
| 2,531,379 | 11/1950 | Chickering | 171/133 X |
| 2,565,559 | 8/1951 | Hurdelbrink | 209/669 X |
| 2,618,385 | 11/1952 | Silver et al. | 209/669 |
| 3,028,957 | 4/1962 | Conway et al. | 209/672 |
| 3,219,187 | 11/1965 | Ritze | 209/233 |
| 3,456,319 | 7/1969 | Gier | 29/456 X |
| 4,037,723 | 7/1977 | Wahl et al. | 209/672 |
| 4,091,693 | 5/1978 | Straub | 29/447 X |

FOREIGN PATENT DOCUMENTS

| | | | |
|---|---|---|---|
| 236779 | 5/1960 | Australia | 209/233 |

*Primary Examiner*—Ralph J. Hill

*Attorney, Agent, or Firm*—Burns, Doane, Swecker & Mathis

[57] ABSTRACT

A screen intended for screening pulp chips or equivalent, wherein two or more screen baskets are fitted one above the other. At least one of these baskets consists of two or more screw spirals journalled to the screen basket, the spiral wings of said spirals being fitted as interlocking in between each other. The outer circumference of each wing extends to the proximity of the mantle face of the core part of the adjoining spiral. The adjoining spirals are opposite-handed and have opposite directions of rotation, their rotation being synchronized in relation to each other, and the distance of the interlocking parts of the wings from each other corresponds to the maximum acceptable thickness of the chips.

Two screen baskets fitted one above the other are supported by the frame, and they are connected to each other by units that permit free movement of vibration of one or both of the screen baskets. The movement of vibration is produced by transferring a cam shaft movement from one basket to the other.

7 Claims, 24 Drawing Figures

Fig. 3.
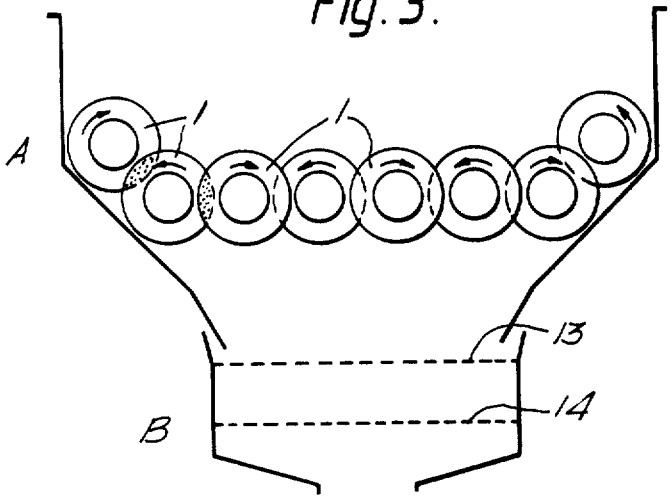
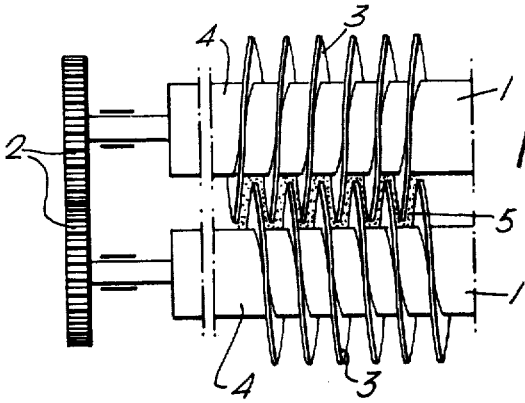
Fig. 4.
Fig. 5.
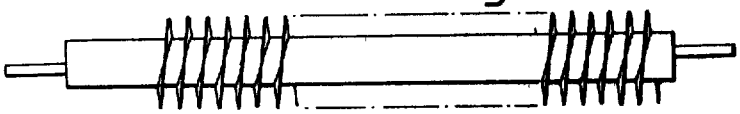
Fig. 6.
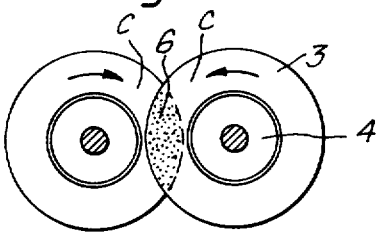
Fig. 7
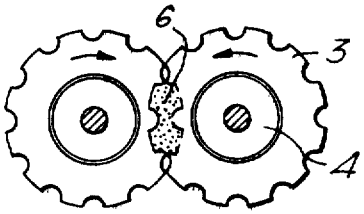

SCREEN

This application is a continuation-in-part of copending application Ser. No. 165,863, filed July 7, 1980, abandoned.

The present invention is concerned with a screen intended for screening pulp chips or equivalent, the screen face of which screen consists of rotary units mounted on shafts and interlocking each other. The invention is also concerned with a method for the manufacture of the screen.

The screen subject of the invention relates to the screening of chips intended for pulp. The screen may also be used for screening sawdust.

The cooking chips of the pulp industry are obtained from the crude chips by separating the chips from the oversize fraction (sticks) and the sawdust. The oversize fraction is recovered by rechipping it. The sawdust is cooked either separately or together with the cooking chips, but it is very commonly also used as fuel.

The traditional screening involves two drawbacks:

The screening takes place by means of screen plates perforated in accordance with the size (width-length) of the chips. The size of the chip particles usually varies: width about 15 to 20 mm, length about 20 to 30 mm, and thickness about 3 to 8 mm. Thus, the thickness of the chip particles is considerably smaller than the other dimensions, i.e. the two other dimensions are about 2- to 10-fold as compared with the thickness. In cooking the thickness of the chips has a great importance. Excessively thick chip particles remain crude in the cooking and therefore require expensive after-treatment. The thickness of the chips, on the average, follows the size of the chips, but, mainly resulting from knots, chip particles of the correct size but of remarkably excessive thickness are produced, which, with the present screening method, end up in the cooking chips with the detrimental effects mentioned above.

The sticks and the sawdust are separated from the cooking chips by means of the same screening movement, whereby the predominant type of movement is the peaceful, wide-range, horizontal screening movement suitable for the sticks. This movement is poorly suitable for sawdust, and the sawdust tends to adhere to the screening surfaces and to block the small screening holes. This is why, in order to separate the sawdust from the cooking chips, screen holes that are excessively large in view of the result must be used, whereby the sawdust contains a remarkable quantity of the valuable needle fraction, in addition to the powder fraction. The value of use of the sawdust increases considerably if the powder fraction and the needle fraction can be separated from it in connection with the screening.

A screen is also previously known in which disk rolls provided with separate plane disks are used, in which rolls the plane disks interlock with each other to constitute the screen slot. A drawback of the disk screen is that chip particles are wedged and blocked in between the disks.

The shortcomings mentioned above have been eliminated in the present screen, in which the separation of the oversize fraction is based on the thickness of the chips and the sawdust has a separate sharp screening movement of its own, by means of which the sawdust can be divided into a powder fraction and a needle fraction right in connection with the screening. The screen in accordance with the invention is mainly characterized in that the rotary units are synchronously driven screw spirals that are arranged as interlocking each other.

In one embodiment of the present invention the vibrating movement produced by screw spirals fitted eccentrically is utilized in order to vibrate screens fitted underneath the spirals. Then, two or more screening faces have been fitted into a screen basket of the screen, of which screening faces at least one consists of two or more synchronously driven eccentric screw spirals, whose spiral wings are fitted as interlocking between each other so that the outer circumference of each wing extends to the proximity of the mantle face of a core part of the adjoining spiral, whereby adjoining spirals are opposite-handed and they rotate in opposite directions.

The screen basket is fastened to a stationary frame by means of units that permit movement of the screen basket by the effect of the force that is caused by the eccentrically rotating spirals, whereby the eccentrically rotating spirals intensify the screening movement of the spiral plane and at the same time produce a vibrating movement of the entire basket.

The production of the vibrating movement of such a massive apparatus as a screen basket normally requires a high-power vibrator, whose fixing onto the screen basket having a relatively small area, according to experience, causes difficulties.

A spiral battery consisting of eccentric spirals and having a large fastening area is a technically advantageous solution for the production of the movement of vibration concerned. Also, the eccentricity of the spirals is a highly advantageous solution from the point of view of the thickness screening.

In a device in accordance with an embodiment of the present invention, the movement produced by a crank shaft fitted onto the shaft of a screw spiral is employed in order to vibrate the perforated sheet screens fitted underneath the spiral screen face, as combined with chipping and after-screening of the oversize fraction.

In order that it should be possible to arrange several spirals as interlocking each other, the dimensioning and distribution of the spirals must be definitely precise. The angle between the spiral wing and the core part must also be a right angle. In the contrary case the wings cannot rotate freely as interlocked with each other.

Another object of the present invention is to provide a method by means of which it is possible to produce such spiral wings with a very high precision and at the same time, nevertheless, in a simple and economical way. The method in accordance with the invention is mainly characterized in that one or several screw-line-shaped grooves corresponding the base portion of the spiral wing are machined into the core part and each spiral wing, manufactured in a way in itself known, is fitted onto the core part into the spiral groove so that the end of the spiral wing is first placed at the end of the groove in the core part and the spiral wing is thereafter turned and pushed in relation to the core part until the wing is in its position around the core part.

By means of the method in accordance with the invention, advantages of both manufacture and of technology are achieved. Advantages of manufacture are, e.g., the following ones:

The method is economical owing to the high speed and to the precision.

No mistakes resulting from human factors can occur in the assembly of the spirals.

In the assembly, the spiral wings have to be fastened to the core parts only at the ends of the spiral. Then, in the core part, no deformations caused by heat tensions resulting from welding are produced, so that the long core part remains straight.

The mode of manufacture concerned, both in theory and in practice, permits even very little spacing between adjoining spiral wings (4 to 6 mm, even 2 mm). A little slot is necessary, e.g., when sawdust is screened.

A technical advantage is above all the dimensional precision of the spirals manufactured by means of the method. Owing to the principle of operation of the spiral screen, even the slightest fault cannot be permitted in the pitch of the spiral wings in the spirals. By means of the mode of manufacture in accordance with the invention, an absolute precision is achieved. When a screen plane is assembled out of spirals, no matching and trimming of the wings is required any longer, but the completed spirals are mounted onto their bearings in the correct positions, and they fit to rotate side by side as such.

BRIEF DESCRIPTION OF THE DRAWINGS

The invention will be described more closely below with reference to the attached schematical drawings, wherein FIG. 3 is a cross-sectional view of the same screen, FIG. 4 is a view from above of a pair of spirals to be used in the screen above, FIG. 5 is a side view of one embodiment of the spiral used in the screen, FIG. 6 is an end view of the pair of spirals shown in FIG. 4, FIG. 7 is an end view of another embodiment of a pair of spirals.

DETAILED DESCRIPTION OF THE PREFERRED EMBODIMENTS

Figure 1:
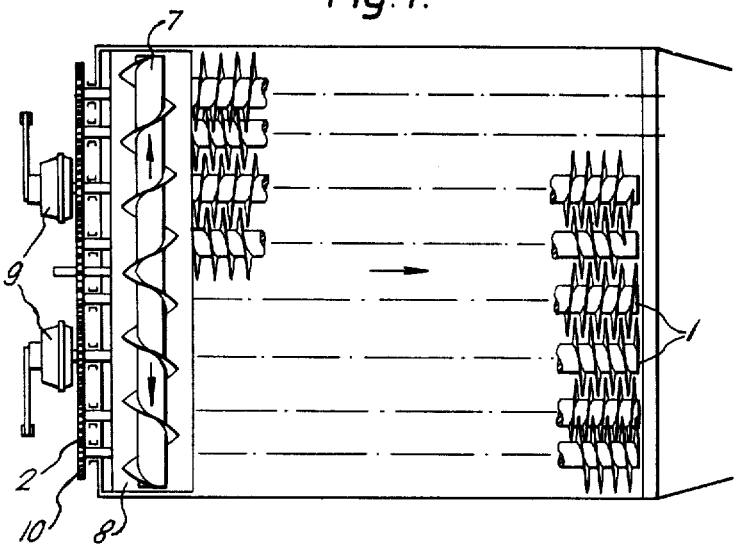
FIG. 1 illustrates one embodiment of the screen in accordance with the invention as viewed from above.
Figure 2:
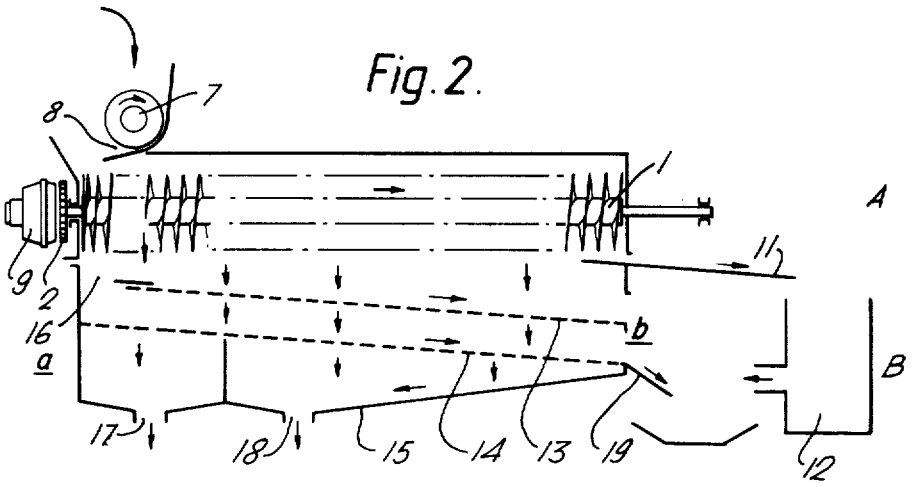
FIG. 2 is a side view of the same screen.

The screen consists of two separate blocks A and B, placed one above the other. The upper screen A comprises a screen plane consisting of rotary spirals for the purpose of separating any overthick fraction from the cooking chips, and the lower screen B comprises hole planes for the separation of the sawdust from the cooking chips and for further division of the sawdust into a powder fraction and a needle fraction.

The spiral plane of the upper screen A usually consists of several pairs of spirals (FIGS. 4 and 6). In a pair of spirals the right-hand spiral 1 and the left-hand spiral 1 rotate in opposite directions as synchronized by gears 2 so that the spiral wings 3 rotate appropriately as interlocking with each other while their outer circumferences extend to the proximity of the mantle face of the core part 4 of the adjoining spiral. The spiral wings interlocking each other form the slot area of the screen plane (shaded area 5 and 6 in FIGS. 6 and 7), wherein the width of the slot corresponds the maximum permitted thickness of the chips (e.g. 5 to 8 mm). The spiral plane mentioned above is assembled out of pairs of spirals so that therein adjoining spirals 1 are connected to each other in the way described in connection with the construction of the pair of spirals. The extreme spirals in the plane have been elevated above the plane, and their direction of rotation prevents the falling of chips over the lateral edges of the screen plane (FIG. 3).

The chips are fed to the beginning of the screen plane, e.g., by means of a screw feeder 7. The chips fed to the middle of the plane is spread towards the sides of the screen uniformly by means of an adjustable bottom plane 8. The spirals 1 in the spiral plane are driven by drives 9 of flexible speed of rotation, and the synchronization of the spirals takes place by means of a gear transmission line 10 consisting of cogwheels 2.

The chips of accepted thickness, i.e. most of the chips, fall through the slots 5 and 6 in the spiral plane down onto the lower screen B. Overthick chip particles are carried by the spirals to the final end of the upper screen A and fall onto a vibrator plane 11 connected to the lower screen B and from there further into the after-chipper 12, from where they are, as chipped, carried straight into the cooking chips or back to the beginning of the upper screen A.

The spirals 1 may be one-headed, preferably, however, multi-headed. The more heads a spiral has, the higher is its pitch and, correspondingly, the transportation speed. Higher pitch also increases the rigidity of the spiral wing.

The pitch of the spiral 1 may either be constant or increase with the direction of transport. The first case increases the effective screening surface, the latter case increases the readiness of liberation of the chips from the screen slot.

As the adjoining spirals 1 are opposite-handed, the parts 6 of their spiral wings interlocking each other are practically parallel and the width of the screen slot remaining between said parallel parts is nearly constant.

The spirals 1 may be eccentric in order to increase the screening efficiency. One alternative of eccentricity is shown in FIG. 5, wherein the centre line of the support shaft and the centre line of the core tube cross each other in the transversal centre plane of the spiral plane. In such a case the spirals are constructed so that they can be synchronized both in respect of the interlocking of the spiral wings and in respect of the requirements of the eccentricity. In the eccentricity case in accordance with the example, when several spirals have been arranged side by side so that their support shafts are parallel, the high and low phases of the rignt-hand and left-hand spirals alternate, and, moreover, they do this in the way of mirror image in respect of the transversal centre line of the spiral plane, as the spirals rotate.

The outer circumference of the spiral wings 3 of the spirals 1 may be notched (FIG. 7) in order to increase the screening efficiency. The spiral plane may be rising in the direction of transport. In a rising spiral plane the screening is intensified, because the chip particles rising "uphill" seek their way through the screening slots more readily. The rise of the overthick chips reduces the drop loss in the process chain.

The lower screen B consists of perforated screen planes 13 and 14 placed one above the other and of a closed plane 15 underneath the perforated planes, as well as of a feeding chute 11 for the oversize chips, placed underneath the final end of the upper screen A. The planes 13 and 14 may be made either of wire net or of perforated sheet. The plane 13 separates the sawdust and the small chips from the chips. Underneath the plane 13 there is the screen plane 14 proper. The planes 13 and 14 are inclined so that their beginning is somewhat higher than the final end. The lower screen B has a short-range and sharp screening movement.

The cooking chips including sawdust fall from the upper screen A onto the screen plane 13 placed underneath, which plane functions as an auxiliary plane. The hole size of that plane (8 to 12 mm) has been selected so that it retains most of the cooking chips and gives access to the sawdust plane 14 placed underneath only to sawdust and a little part of the small fraction of the cooking chips. This intensifies the operation of the sawdust plane 14 thereby that

- it is easier to screen a little quantity of goods,
- owing to the little quantity of goods, it is possible to use a thinner screen plane in the sawdust plane 14, whose holes remain open more readily than holes of a thick plane.

The operation of the sawdust plane 14 is further intensified decisively thereby that there is an adjustable opening 16 or equivalent at the initial end of the auxiliary plane 13, by means of which opening it is possible to take a desired quantity of the chips that have come straight through the spiral plane to the initial end of the sawdust plane 14. These chips, which are considerably heavier than the sawdust, by their rubbing movement guarantee that even small sawdust holes remain open when the chips pass over the entire screen plane 14.

Through the smaller holes (2 to 4 mm) at the initial end a in the sawdust plane 14 the wood dust is separated from the sawdust while leaving the screen through the drop opening 17 in the plane 15. Through the larger holes (4 to 6 mm) at the final end b of the sawdust plane 14, the needle fraction is separated from the fine fraction of the cooking chips while leaving the screen through the second drop opening 18, placed in the plane 15. The cooking chips from the plane 13 join the small fraction of the plane 14 at the chute 19, which passes to the conveyor carrying off all the cooking chips.

As compared with the previously known disk screen mentioned above, the present spiral screen has the following advantages:

- In the spiral screen, owing to the transport effect of the spirals, all chip particles wedged between the spirals (FIG. 6, section c) are carried forward being discharged at the final end of the spiral plane. In this way the spiral screen is self-cleaning.
- Owing to the transport effect of the spirals, the top face of the spiral plane is alive, which intensifies the screening and all the time carries the overthick fraction forward.
- Owing to the transport effect, the spiral plane may be rising. This is adapted to intensify the screening and reduces the drop loss in the process chain, which loss must be compensated for by means of conveyors.
- The screw spiral 3, being continuous and having a self-rigidifying form, may be thinner than the individual plane disks. This increases the effective slot area of the spiral screen.
- The crude chips always include long thin splinters, which cause difficulties of treatment after the screening. These thin splinters can pass through the plane slots in the disk screen but adhere to the spiral-faced openings in the spiral screen and are carried to the after-chipping.
- By adjusting the speed of rotation of the spirals, it is possible to change the screening properties of the spiral screen and thereby, by using the correct speed of rotation, to select the most appropriate screening for different materials.

Figure 10:
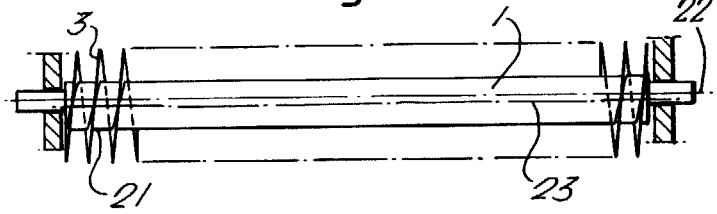
FIG. 10 is a side view of a screw spiral that is used in the screen shown in FIG. 8.
Figure 9:
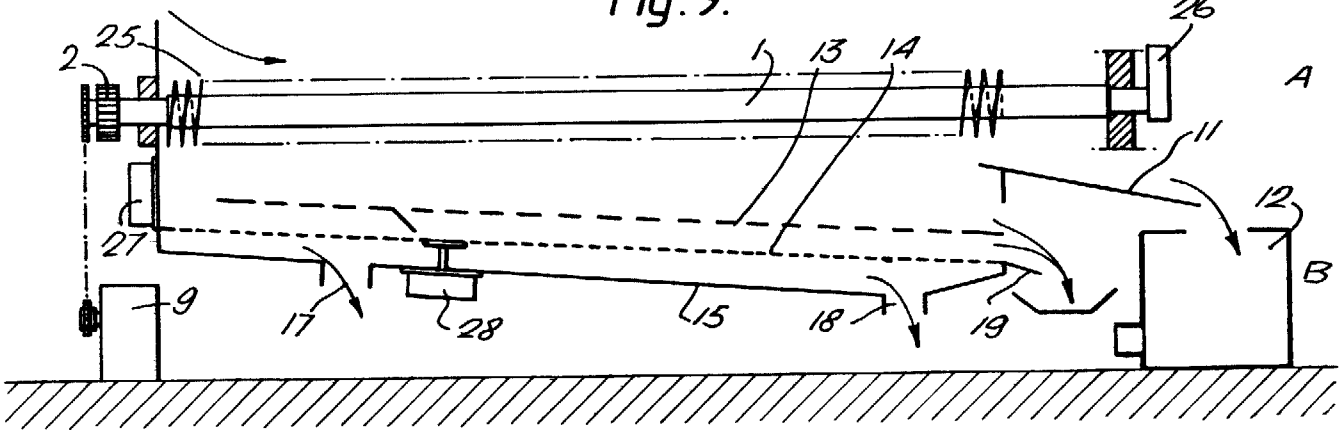
FIG. 9 is a longitudinal section of the screen shown in FIG. 8.
Figure 12:
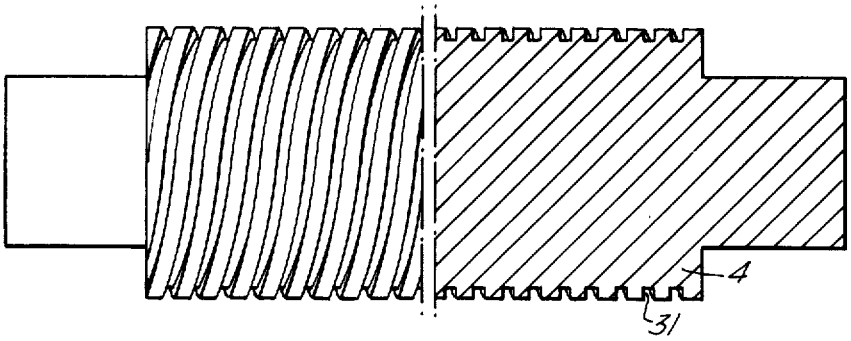
FIG. 12 is a side view of the core part of a screw spiral manufactured by means of the method of the invention, one end of the core part being shown in section.

In the embodiment shown in FIGS. 9 and 10, the spirals 1 in the screen basket 25 are journalled appropriately eccentrically so that the centre axis 23 of each spiral is parallel to the axis of rotation 22 of the spiral and at a distance from some. The spirals are arranged so that the axes of rotation 22 are in the same plane, whereas the centre axes 23 of two adjoining spirals are located in opposite directions as viewed from the axis of rotation of each spiral. In the embodiment shown in FIG. 9, an extra cam 26 for aiding the eccentric motion has been additionally fastened to one of the ends of the spiral, which eccentricity of the cam is, as viewed from the axis of rotation, in the same direction as the eccentricity of the spiral wing.

Moreover, at the other end of the screen basket, there is a separate auxiliary vibrator 27. A little additional vibrator 28 has been mounted onto the screen plane 14 and onto the closed plane 15. When constantly in operation, the additional vibrator 28 intensifies the screening, and when used intermittently, it may be used for keeping the planes concerned clean.

Figure 8:
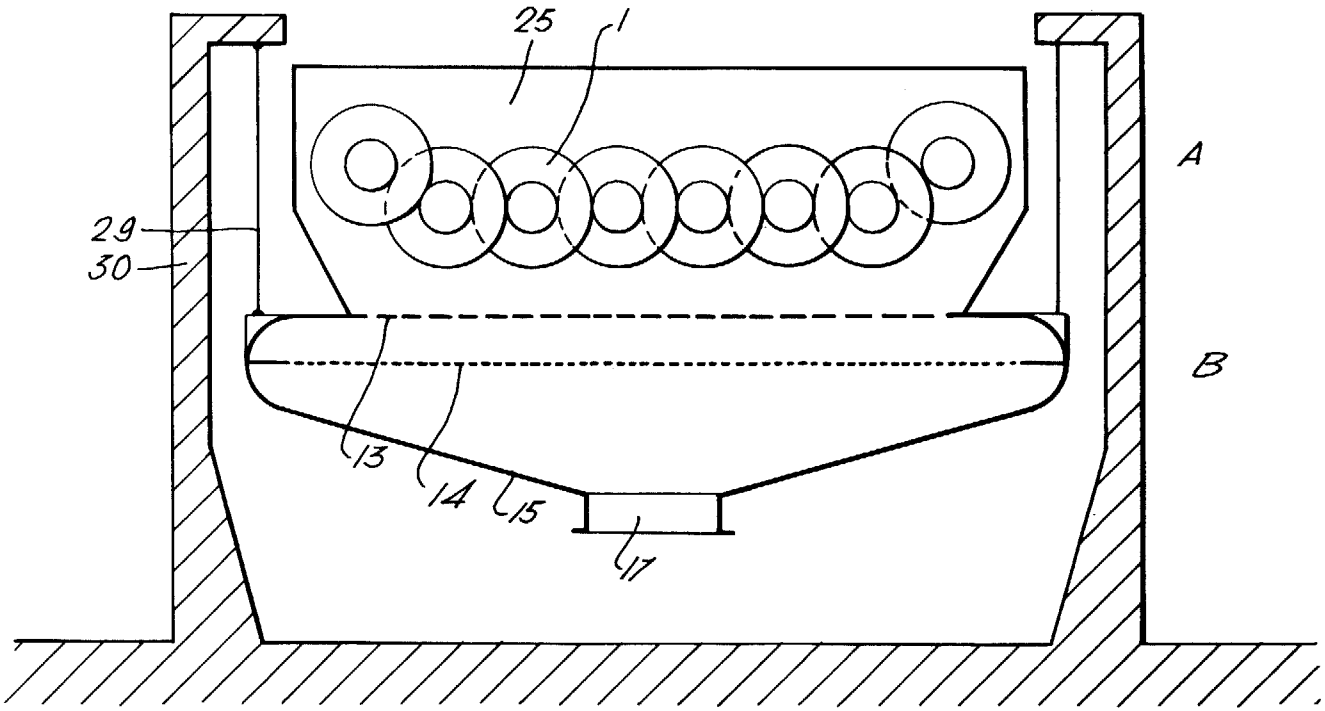
FIG. 8 is a cross-sectional view of another embodiment of the screen in accordance with the invention.

The screen basket 25 is by means of flexible units 29 (FIG. 8) fastened to the stationary frame 30 of the screen. The drive mechanism 9 of the screen is connected to the cogwheels 2 fastened to the shafts of the spirals by the intermediate of a transmission which permits horizontal movement of the screen basket back and forth.

Figure 11:
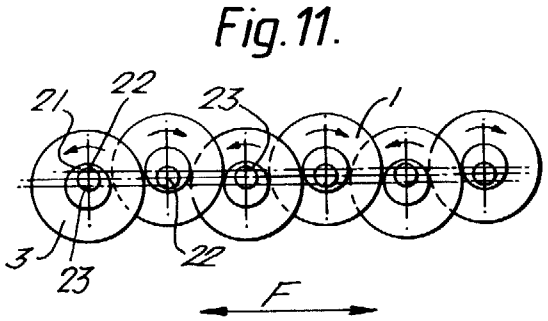
FIG. 11 illustrates the rotation of eccentric spirals and the force of vibration resulting from same.

When the screen is in operation, the spirals, which rotate eccentrically, produce, in the horizontal plane, a resultant mass force F (FIG. 11) back and forth. The vertical resultant is zero, because the forces affecting vertically of two adjoining spirals have opposite directions and thereby overrule each other. In FIG. 11 the spirals are illustrated in a position in which the centre axis 23 of each spiral is, as viewed from the axis of rotation 22, either upwards or downwards. When the movement goes on from the position shown in FIG. 11, the centre axes 23 of all the spirals first move in the figure to the right thereby producing a force resultant effective to the right. Thereupon the movement of rotation goes on and the centre axes 23 of all the spirals move to the left correspondingly producing a force resultant directed to the left in the figure. Thereupon the movement still continues back to the position shown in FIG. 11, whereby the revolution has been completed.

The force resultant described above and acting back and forth in the horizontal direction makes the entire screen basket vibrate in the horizontal plane in the direction perpendicular to the longitudinal direction of the spirals, whereby the screen planes 13 and 14 of the basket receive the necessary screening movement. The basic screening by the spirals 1 is produced by their rotation, and this basic screening is decisively intensified by the said eccentric and vibration movement.

The extra eccentric cams 26 are not necessary, nor is the auxiliary vibrator 27 or the additional vibrator 28. If desired, it is, however, possible to use even several extra eccentric cams, auxiliary vibrators and additional vibrators. Instead of flexible units 29 it is also possible to use an appropriate fastening by means of articulated joints, e.g. articulated rods, or suspension on wire ropes or chains. Instead of fastening by hanging, it is also possible to fasten the basket to the frame so that the frame supports the basket from underneath the basket. The connection in this arrangement can be performed by means of gliding or rolling means, e.g. rolls or balls.

Also, the screen planes placed underneath the upper plane, for example the sawdust plane 14, may consist of spirals. If required, the spirals in the sawdust plane may be arranged so that their longitudinal axes are placed transversely to the spirals in the upper plane. If spirals are used in order to form the sawdust plane, the spiral wings and the slots between them must, of course, be dimensioned in accordance with the particle size of the sawdust.

Figure 19:
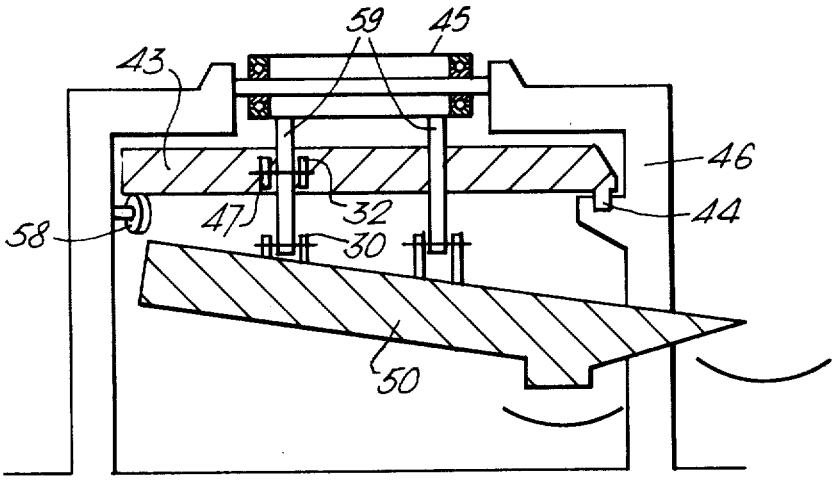
FIGS. 19 and 20 are longitudinal sections of screens in accordance with two embodiments of the invention, in particular articulated rods between the screen baskets.
Figure 20:
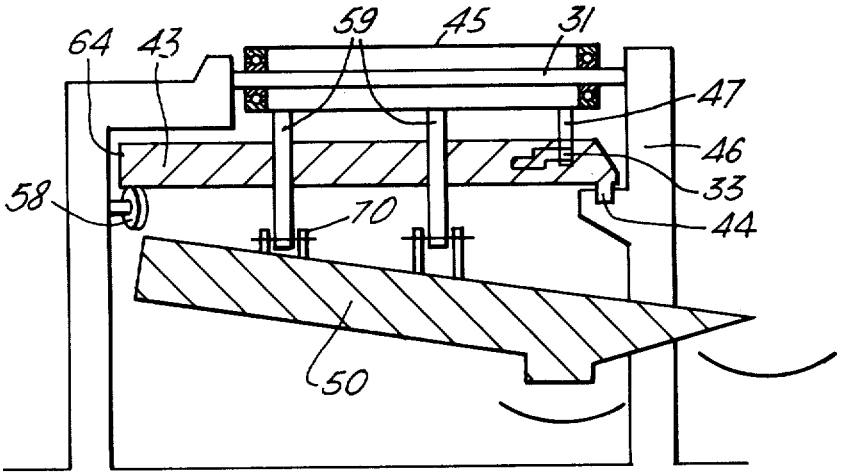
Figure 21:
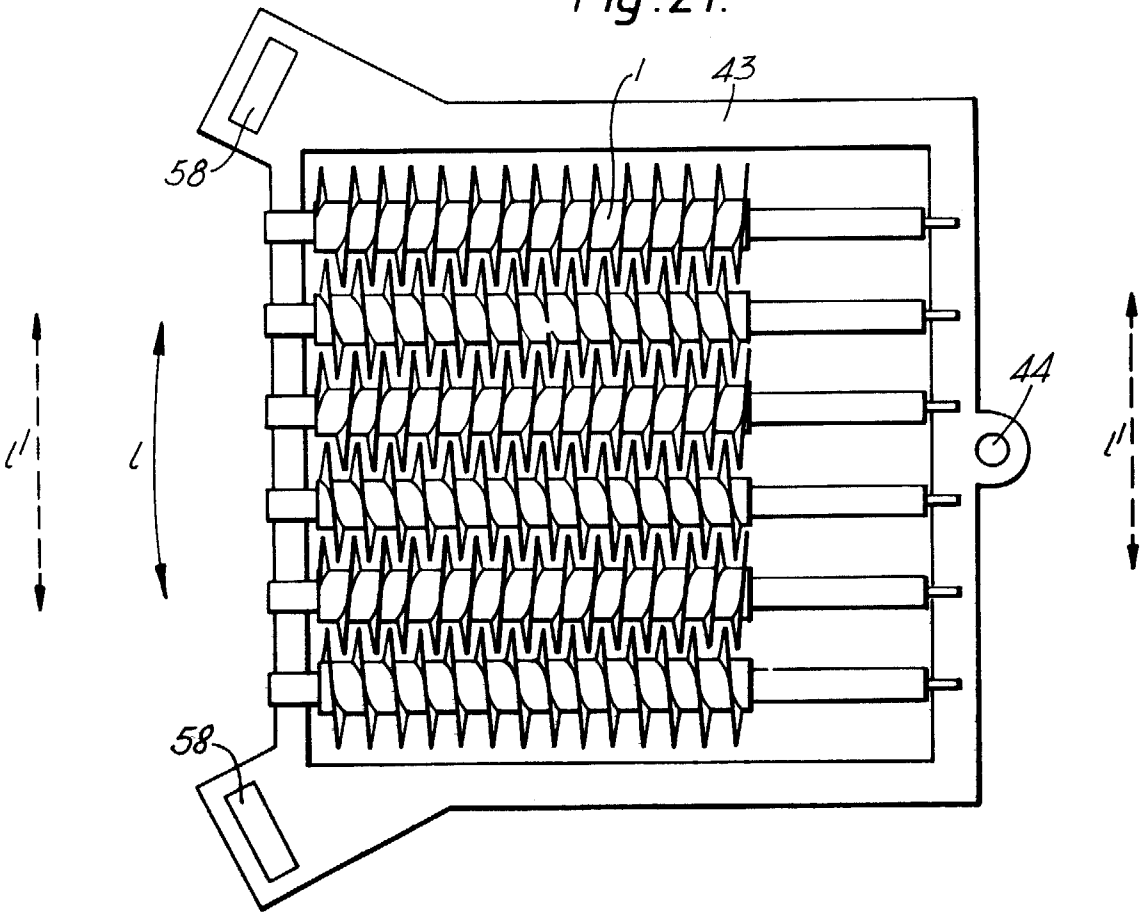
FIG. 21 is an upper view of a spiral screen face.

In the embodiment in accordance with FIGS. 17 to 21, the screen basket 43 of the upper section A rests on a centre pin 44 supported by the frame 46 and on support wheels 58 or on corresponding gliding or rolling means or elastic means (FIG. 21). The pin 44 is placed at the final end, i.e. output end, of the spiral plane.

Figure 18:
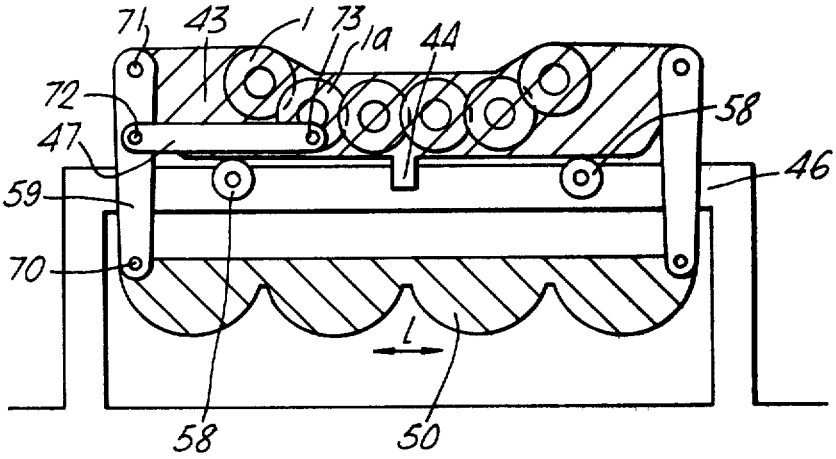
FIG. 18 is a cross-sectional view of a screen in accordance with another embodiment of the invention.

The screen basket 50 of the lower section B with its screen planes 13 and 14 is fastened by means of articulated joints to the lower ends 70 of four articulated rods 59, while the upper ends 71 of the rods 59 are fastened by means of articulated joints to the frame 46 (FIG. 17) or to the screen basket 43 (FIG. 18). If the upper ends of the rods 59 are fastened to the frame, it is possible to use a concave rail along which the support wheels 58 roll, and in this way to centralize the movement of the basket 43.

The screen basket 43 is fastened to the rod 59 at point 72 by means of an arm 47 transverse to the shafts of the spirals, and the opposite end of the arm 47 is connected eccentrically by means of an articulated joint to the crank shaft 73 formed at the end of the spiral 1*a*. The arm 47 may be elastic.

The synchronization of the rods 59 placed on one longitudinal side of the screen takes place by means of the spiral 1*a*, whose both ends are provided with crank shafts rotating synchronously with each other and with arms 47 attached to the crank shafts, or by means of a tubular beam 45, connecting the rods 59 and mounted to the frame 46 or to the screen basket 43 (FIGS. 19 or 20). From FIG. 20 it is seen that the articulated joints of the arms 47 and rods 59 do not necessarily have to be in the same transverse plane. The end of the arm 47 is in this case fastened to the beam 45 at the proximity of the output end of the screen.

When the spirals rotate, the crank shaft 73 at the end of the spiral 1*a*, by the effect of the crank movement, together with the combination of arms 47 and rods 59, produces a back and forth horizontal movement of its own as a forced movement on the screen baskets 43 and 50, said movements having a direction opposite to each other and the length "1" of stroke being in principle inversely proportional to the masses of the screen baskets 43 and 50.

The crank movement transferred by the arm 47 brings the input end 64 of the screen basket 43 into a pendulum movement in the horizontal plane in relation to the centre pin 44, thereby intensifying the thickness screening of the chips and the spreading of the chips towards the sides of the screen at the feeding-in area 64. The thickness screening by the spirals 1 is produced out of their rotation, which is additionally intensified by the above movement of the screen basket 43. Further, by the intermediate of the articulated rod 59, the screen basket 43 brings the screen basket 50 into a horizontal movement parallel to the frame 46 or to the screen basket 43 but of a direction opposite to that of the movement of the screen basket 43.

The forces produced by the crank movement in the rods 47 and 59 as well as in their articulated joints 70, 71, 72, and 73 have been made as low as possible. In respect of the screen basket 43 the movement has been concentrated mainly to the input end 64 of the screen basket, where it is required. This can be accomplished best as a pendulum movement in respect of the point 44.

Figure 22:
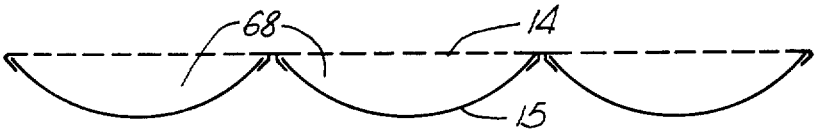
FIGS. 22 and 23 is a detailed view of the construction of the screen.
Figure 23:
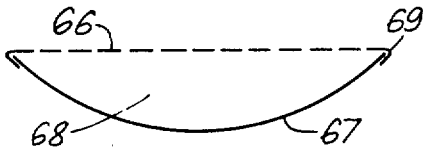

The screen basket 50, where the movement "1" is parallel to the frame 46 or to the basket, has been made as light as possible in the way shown by FIGS. 22 and 23. The screen plane 14 and the closed plane or bottom 15 are composed of blocks 68. A block consists of a screen plate block 66, the edges 69 of whose longitudinal sides are turned in the way shown in FIG. 23. The straight plane plate 67 has been fastened to the plate 66 by forcing so that it remains in position by means of the state of tension caused by bending. In this way one achieves a construction of minimum weight, the necessary tensioning force for the screen plate blocks 66, and the rigidity yielded by the state of tension for the plate 67.

In stead of using an articulated-joint pin 44 and support rolls 58, the supporting of the screen basket 43 at all of the three points may also be arranged by suspending it on springs, steel wires, ropes, or chains. Articulated rods may also be used for supporting the basket.

The pin 44 and the wheels 58 may also be substituted for by balls fitted between two concave spherical faces. In such a case one of the spherical faces is fastened to the frame 46 and the opposite face to the basket 43. In this mode of support, the movement of vibration of the screen basket 43 is not a pendulum movement, but both of its ends move (denoted with broken lines by means of arrows 1' in FIG. 21). Thereby, both baskets can move in opposite directions as compared with each other. The forces that result from their movements of vibration have opposite directions and are of equal magnitude, thereby compensating for each other. The amplitude of the movement of each basket is inversely proportional to the total mass of the basket and of the chips included in the basket. In such as case the great advantage is achieved that the movements of opposite directions of the screen baskets 43 and 50 counterbalance each other, even with varying chip loads. Under these circumstances, the movements of vibration of the screen baskets cause hardly any forces acting upon the frame 46 and upon the building.

Instead of balls and concave spherical faces, it is also possible to use rollers and grooves or rails. In these cases, the essential feature of the supporting of the basket 43 is that the basket 43 can move, within the limits defined by the articulated rods, freely back and forth in the transversal direction. Also, the supporting of the basket 50 may be arranged from underneath in a corresponding way by means of balls placed between concave faces or by means of wheels running along rails. The rolling units are fitted so that they permit lateral movement of the basket 50 both in relation to the frame 46 and in relation to the basket 43.

The supporting of the baskets described above, by means of rolling units, may also be fitted above the baskets, in which case the baskets may be fastened to the rolling units rigidly by means of supporting means of appropriate type, e.g. by means of rods.

The fastening of the articulated rods may also be arranged in many different ways. If one end of the arm 47 is, instead of the rod 59, fastened straight to the frame, by means of the crank shaft 73 it is only possible to produce movement of vibration of the basket 43. It is also possible to fasten one end of the arm 47 straight to the basket 50. If the arm 47 is fastened straight to the basket 50, its length and fastening points are preferably selected so that the arm is in an inclined position in all the operating positions of the screen. If one end of the arm 47 is fastened to the basket 50, instead of the rods 59 it is possible to use wires, chains or ropes for supporting the basket 50. The rod 59 may be supported either to the frame 46 or to the basket 43, besides at its upper end, also at some point between its ends.

It is also possible to arrange the supporting of the baskets so that the basket 43 is stationary and only the basket 50 moves.

Instead of rigid articulated rods, it is also possible to use, e.g., a tensioned steel rope or equivalent for transferring the crank movement.

It is also possible to arrange the transmission arms in such a way that the lower basket is vibrated in the longitudinal direction of spirals 1.

Figure 24:
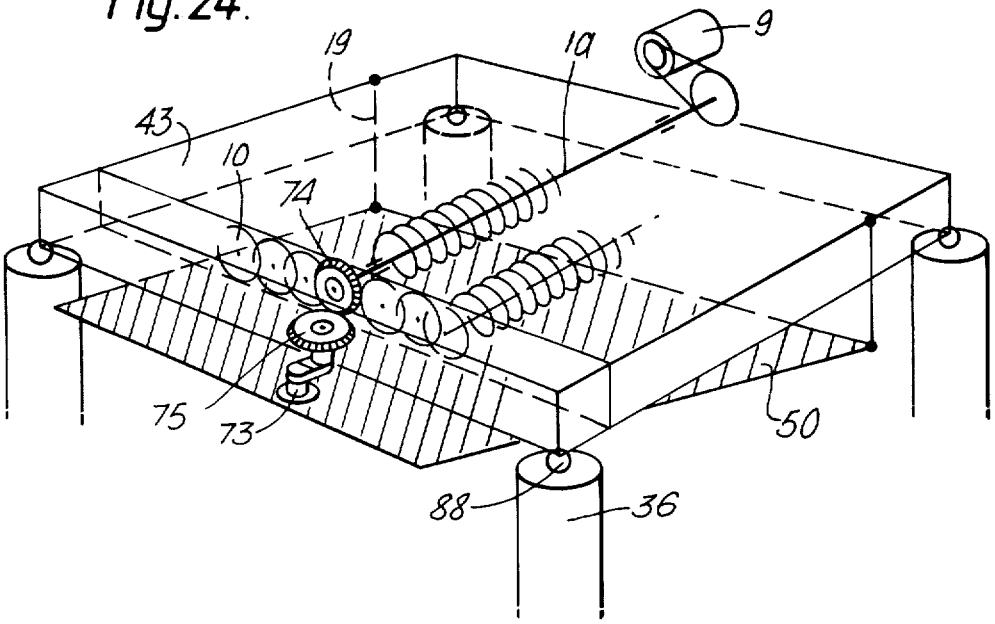
FIG. 24 is a perspective view of still another embodiment of the invention.

In the embodiment of FIG. 24, the basket 43 is supported at its four corners by balls 58 between two concave spherical faces on frame 36. The assembly of spirals 1 joined by gears 10 is run by means of motor 9. At the end of one of the spirals, there is a conic gear wheel 74 mating with a vertically arranged conic gear wheel 75. The gear wheel 75 is mounted on a vertical crank shaft 73. The lower end of the crank shaft 73 is fitted rotatably in the middle of one side of the lower basket 50 while its upper end is fitted rotatably in the upper basket 43. The two corners of the side opposite to the crank shaft in the lower basket 10 are supported by means of steel ropes 19.

When the motor 9 drives the spirals 1, the rotation of spiral 1*a* is transferred to the crank shaft 73. The lower basket 50 obtains a rotating screening movement while the upper basket 43 also rotates but in opposite direction. Again the ratio between the movement ranges of the two baskets is settled according to the ratio of the masses of the baskets.

FIGS. 12 to 16 illustrate the manufacture of the spirals.

The spiral 1 consists of a cylindrical core part 4 and of a one-headed, preferably multi-headed, e.g. 4- to 6-headed, set of spiral wings. The core part 4 may be either a solid axle or a tube. The diameter of the core part 4 is about 100 to 150 mm and the length about 2 to 3 meters. The height of the spiral wing 3 is about 60 to 100 mm and the thickness about 2 to 3 mm. The pitch of one spiral wing is about 80 to 100 mm, whereby the spacing between adjoining spiral wings in a multi-headed set of spiral wings is about 10 to 20 mm.

The spiral wing 3 is manufactured in a way in itself known, e.g., out of a straight 60 mm×4 mm flat iron by rolling by means of conical rollers, whereby it receives its spiral form and desired pitch and inner and outer diameter. Another alternative is to manufacture the spiral by cutting a radial cut into circular disks provided with centre hole, at the edges of which cuts the disks are connected to each other be welding.

Into the core part 4, a groove 31 of appropriate depth (e.g. about 2 to 3 mm) and form and having a diameter and pitch corresponding the spiral wings is machined by turning on a lathe for each spiral wing. By turning on a lathe, very good precision is achieved in respect of the pitch and spacing of the groove. The cross-sectional form of the bottom of the groove is preferably rectangular.

Figure 13:
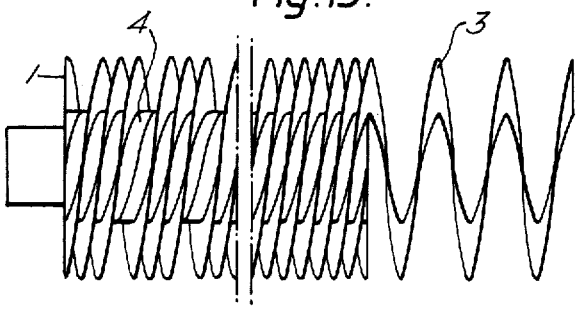
FIG. 13 is a side view showing the assembly of a screw spiral in accordance with the invention.
Figure 14:
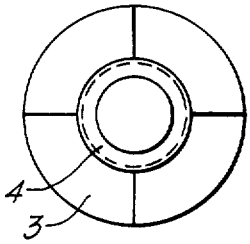
FIG. 14 is an end view of the spiral shown in FIG. 13.
Figure 15:
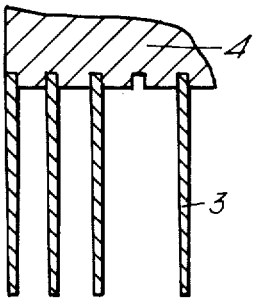
FIG. 15 is an enlarged view of the joint portion between the wings and the core part.
Figure 16:
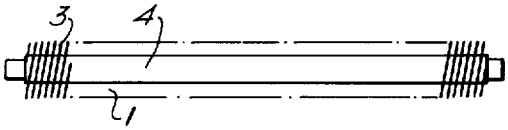
FIG. 16 is a schematic view of a screw spiral manufactured in accordance with the invention.
Figure 17:
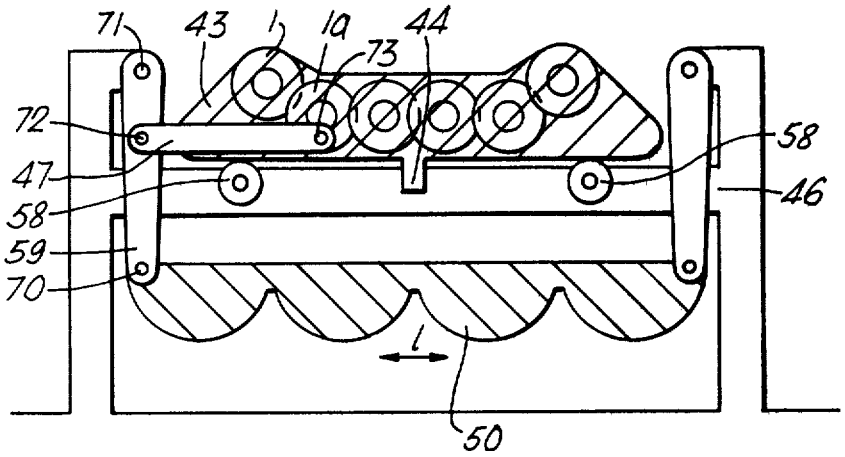
FIG. 17 is a cross-sectional view of a screen in accordance with an embodiment of the invention.

The completed spiral wings 3 are turned around the core part 4 one after the other just like nuts. The connecting can be performed, e.g., by turning the core part and by at the same time pushing the wing part axially. FIG. 13 illustrates this assembly stage. Three wings have already been fitted into position and the last, i.e. the fourth wing is being turned from the right end of the core part onto the core part. If desired, the joint between the core part and the spiral wing may still be made tighter by means of heat treatment; in such a case the inner diameter of the wings is made slightly smaller than the diameter of the portion grooved into the core part. Right before the assembly step the spiral wing is heated or the core part is cooled. When heated, the spiral wing expands and when it cools down after the assembly, it, when shrinking again, is tightly compressed around the core part. The heating may be performed, e.g., by means of hot oil (about 200° C.). In a corresponding way, it is possible to shrink the core part before the assembly by cooling it. The joint may also be tightened by at one of the ends twisting the spiral wing fastened to the core part at the other end, in the appropriate direction around the core part. The spiral wing is finally secured to the core tube by welding at both ends.

The spiral wing may also consist of two parts, in which case the parts are fitted into their position from both ends of the core part. The assembly of the spiral may, of course, also take place either by turning the core part, by turning the wing, or by turning both of them. Likewise, the axial thrust may be directed at either one of the components or at both of them.

The principles, preferred embodiments and mode of operation of the present invention have been described in the foregoing specification. However, the invention which is intended to be protected is not to be construed as limited to the particular embodiments disclosed. The embodiments are to be regarded as illustrative rather than restrictive. Variations and changes may be made by others without departing from the spirit of the present invention. Accordingly, it is expressly intended that all such variations and changes which fall within the spirit and scope of the present invention as defined in claims be embraced thereby.

What is claimed is:

1. A screen for the separation of an oversize fraction from pulp chips on the basis of the thickness of the chips, comprising a screen face having at least two synchronously driven screw spirals, each of said screw spirals includes a core part having a mantle face and a spiral wing secured around the core part, said spiral wings are arranged to interlock in between each other, an outer circumference of each wing extends to the proximity of the mantle face of the core part of the adjoining spiral, adjoining spirals are opposite-handed and have opposite directions of rotation, and the distance between the interlocking portions of the wings being less than the distance between mantle faces of adjoining spirals and corresponding to the maximum acceptable thickness of the chips.

2. The apparatus as claimed in claim 1, further comprising means for vibrating the screen face to assist movement of the chips.

3. A screen as claimed in claim 1, wherein the screen basket consisting of the spirals is supported on the frame by rolling units and is connected to a frame by a support pin substantially perpendicular to the bottom of the screen basket, the screen basket being permitted to turn about the pin by the effect of the vibration, said pin is placed in the proximity of the output end of the screen basket.

4. The apparatus as claimed in claim 1, further comprising at least one additional screen face fitted in a screen basket in addition to the screen face comprised of the eccentric spirals, the screen basket is connected to a stationary frame by units which permit movement of the screen basket by the effect of the force that results from the eccentrically rotating spirals, the eccentrically rotating spirals intensifying the screening movement of the spiral screen face and at the same time producing a vibrating movement of the basket.

5. The apparatus as claimed in claim 4, wherein a central axis of each spiral is parallel to the axis of rotation of the spiral and at a distance from same, the spirals being arranged so that the central axes of two adjoining spirals are located in opposite directions as viewed from the axis of rotation of each spiral.

6. The apparatus as claimed in claim 1, further comprising a vibrating screen fitted underneath the screen face comprised of the spirals and including two screen planes placed one above the other, said vibrating screen having a hole size in the upper plane which hole size is larger than a hole size of the lower plane, a desired quantity of cooking chips being passed to the lower plane from the upper plane through an adjustable opening, the size of the adjustable opening being such that the main portion of the cooking chips remain retained on the upper plane.

7. A method for screening chips for pulp which have a thickness substantially smaller than their length and width, comprising the steps of permitting the chips to pass through slots the side walls of which are formed by surfaces partially overlapping and rotating around at least two parallel shafts, the distance between two adjacent side wall surfaces on two adjacent shafts being less than the distance between the adjacent shafts and corresponding to the maximum acceptable thickness of the chips, forming the surfaces of the slot side walls by an assembly of screw spirals, extending the circumference of each spiral to the proximity of a mantle surface of the shaft of an adjacent spiral, and rotating the adjacent spirals in opposite directions.

* * * * *